US012529220B2

(12) United States Patent
Stanfield

(10) Patent No.: US 12,529,220 B2
(45) Date of Patent: Jan. 20, 2026

(54) TOILET BOWL CLEANING CUP SYSTEM

(71) Applicant: Jerald Christopher Stanfield, Gilbert, AZ (US)

(72) Inventor: Jerald Christopher Stanfield, Gilbert, AZ (US)

( * ) Notice: Subject to any disclaimer, the term of this patent is extended or adjusted under 35 U.S.C. 154(b) by 86 days.

(21) Appl. No.: 18/636,491

(22) Filed: Apr. 16, 2024

(65) Prior Publication Data

US 2025/0320707 A1 Oct. 16, 2025

(51) Int. Cl.
*E03D 9/03* (2006.01)

(52) U.S. Cl.
CPC ..... *E03D 9/038* (2013.01)

(58) Field of Classification Search
CPC ..... E03D 9/038; E03D 9/033; E03D 9/03
USPC ..... 4/227.1
See application file for complete search history.

(56) References Cited

U.S. PATENT DOCUMENTS

| | | | | |
|---|---|---|---|---|
| 2,570,934 A | | 10/1951 | Foster | |
| 3,228,040 A | | 1/1966 | Currie | |
| 3,290,698 A | | 12/1966 | Joyner | |
| 3,311,931 A | | 4/1967 | Kristensen | |
| 3,407,412 A | * | 10/1968 | Spear | E03D 9/038 222/416 |
| 5,815,850 A | * | 10/1998 | Shon | E03D 9/02 4/225.1 |
| 5,918,320 A | * | 7/1999 | Reals | E03D 9/02 4/225.1 |
| 6,321,392 B1 | | 11/2001 | Sim | |
| 10,570,600 B2 | | 2/2020 | Holguin | |
| 11,821,189 B1 | | 11/2023 | Stanfield | |
| 2004/0117899 A1 | | 6/2004 | Nguyen et al. | |
| 2015/0013058 A1 | | 1/2015 | Bucher et al. | |
| 2017/0058500 A1 | * | 3/2017 | Garrels | C11D 7/04 |
| 2017/0211266 A1 | * | 7/2017 | Galligar | E03D 9/031 |
| 2019/0360187 A1 | * | 11/2019 | Aldridge | E03D 9/038 |

OTHER PUBLICATIONS

USPTO, Notice of Allowance dated Sep. 19, 2023 in U.S. Appl. No. 17/892,667.

* cited by examiner

*Primary Examiner* — Huyen D Le
(74) *Attorney, Agent, or Firm* — SNELL & WILMER L.L.P.

(57) ABSTRACT

The system may comprise an overflow pipe within a cannister; the cannister configured to translate along at least a portion of a length of the overflow pipe; a bottom of the cannister configured to adjust to allow tank water to flow into a toilet bowl; a holding device configured to interface with the overflow pipe; the holding device configured to receive fill water; the holding device configured to retain a cleaning substance; and the holding device configured to allow the fill water to flow over the cleaning substance and into the overflow pipe.

14 Claims, 3 Drawing Sheets

TOILET BOWL CLEANING CUP SYSTEM

TECHNICAL FIELD

This disclosure generally relates to a toilet bowl cleaning cup system that keeps the cleaning substance away from the tank parts.

BACKGROUND

Toilets need to be cleaned often, but people do not like to manually clean toilets. Many chemicals, devices and systems exist to clean toilets such as, for example, liquid sprays, tank tablets, push on gel tabs for the bowl, hanging tabs on the bowl lid, brushes and disposable sponges. However, people may not want to use cleaning products that are dispersed directly into the bowl since those products may be unsightly and people do not want such chemicals near their bodies. Other cleaning systems exist that work in the tank, but such tank cleaning systems include chemicals that interface with the tank parts. The chemicals that are dispersed in the tank may damage the tank parts over time. As such, a need exists for a self-cleaning toilet bowl system that is placed in the tank, but the chemicals go directly into the bowl and do not interact with the tank parts.

As set forth in FIG. 1, one type of toilet device (having a flapper device) operates by pushing on a handle 105 that opens a plug 110 (or flapper) in a tank 115. The opening of the plug 110 allows the water to flow out of the tank 115 and into the bowl to help wash down the dirty water out of the bowl and into the sanitation lines. The float rod 120 goes down when the water leaves the tank 115, so the downward movement of the float rod 120 opens the valve to allow clean water to enter into the tank 115. The clean water also travels through a fill tube 125 and into the overflow pipe 130 to partially fill the bowl with clean water. As the tank 115 fills, the float rod 120 rises with the water. When the water reaches the optimum level, the float rod 120 closes the valve and restricts additional water flowing into the tank 115. If water continues to flow into the tank 115, the water level may rise above the top opening of the overflow pipe 130. The water that rises in the tank 115 above the top opening of the overflow pipe 130 enters the overflow pipe 130, then exits the overflow pipe 130 and into the bowl.

As set forth in FIG. 2, another type of toilet device may include a cylindrical plug or cannister such as, the Series 3200 (model number 1187574) toilet device manufactured by Kohler. This type of toilet operates by pushing on a handle 205 that pulls up on a cannister 210 (or cylindrical plug) in a tank 215. The lifting of the cannister 210 allows the water to flow out of the tank 215 and into the bowl to help wash down the dirty water out of the bowl and into the sanitation lines. The float rod 220 goes down when the water leaves the tank 215, so the downward movement of the float rod 220 opens the valve to allow clean water to enter into the tank 215. The clean water also travels through a fill tube 225 and into the overflow pipe 230 (fill tube 225 may be removably connected to overflow pipe 230) to partially fill the bowl with clean water. Cannister 210 may serve as overflow pipe 230, overflow pipe 230 may be part of cannister 210 or overflow pipe 230 may include a separate pipe within cannister 210 (that extends for at least a portion of the length of cannister 210). As the tank 215 fills, the float rod 220 rises with the water. Overflow pipe 230 may act as an alignment device for cannister 210, and may also disconnect from cannister 210. When the water reaches the optimum level, the float rod 220 closes the valve and restricts additional water flowing into the tank 215. If water continues to flow into the tank 215, the water level may rise above the top opening of the overflow pipe 230. The water that rises in the tank 215 above the top opening of the overflow pipe 230 enters the overflow pipe 230, then exits the overflow pipe 230 and into the bowl.

SUMMARY

Systems and methods are disclosed for an improved toilet bowl cleaning cup system. In various embodiments, the system may comprise an overflow pipe within a cannister; the cannister configured to translate along at least a portion of a length of the overflow pipe; a bottom of the cannister configured to adjust to allow tank water to flow into a toilet bowl; a holding device configured to interface with the overflow pipe; the holding device configured to receive fill water; the holding device configured to retain a cleaning substance; and the holding device configured to allow the fill water to flow over the cleaning substance and into the overflow pipe.

The system may further comprise an inner cylinder over a hole in the holding device, wherein the fill water is retained in the holding device until the fill water reaches the height of the inner cylinder, then the fill water starts to overflow into the inner cylinder. The holding device may include a recessed area having a geometric shape that matches a geometric shape of the cleaning substance. The holding device may be configured to receive the fill water from a fill tube. The holding device may include a cover. The holding device may include at least one of a removable cover, a hinged cover or a sliding cover. The system may further comprise at least one of an internal ledge, flare or side internal projection on the holding device to hold a clip that secures a fill tube onto the holding device. An outside bottom of the holding device may include one or more ridges. The holding device may be configured to receive at least one of a re-fill or replacement of the cleaning substance. A geometric shape of the cleaning substance may be similar to the geometric shape of the holding device. The holding device may be configured to directly receive the cleaning substance. The bottom of the cannister may be configured to adjust by translating upward.

The improved toilet bowl cleaning cup system may further comprise, in various embodiments, an overflow pipe interfacing with an exit pipe that provides a pathway for fill water to enter into a toilet bowl; a flap configured to adjust to allow tank water to flow through the exit pipe and into the toilet bowl; a holding device configured to interface with the overflow pipe; the holding device configured to receive fill water; the holding device configured to retain a cleaning substance; and the holding device configured to allow the fill water to flow over the cleaning substance and into the overflow pipe. The flap may be configured to adjust by moving upwards.

BRIEF DESCRIPTION OF THE DRAWINGS

The accompanying drawings, wherein like numerals depict like elements, illustrate exemplary embodiments of the present disclosure, and together with the description, serve to explain the principles of the disclosure. In the drawings.

DETAILED DESCRIPTION

Figure 1:
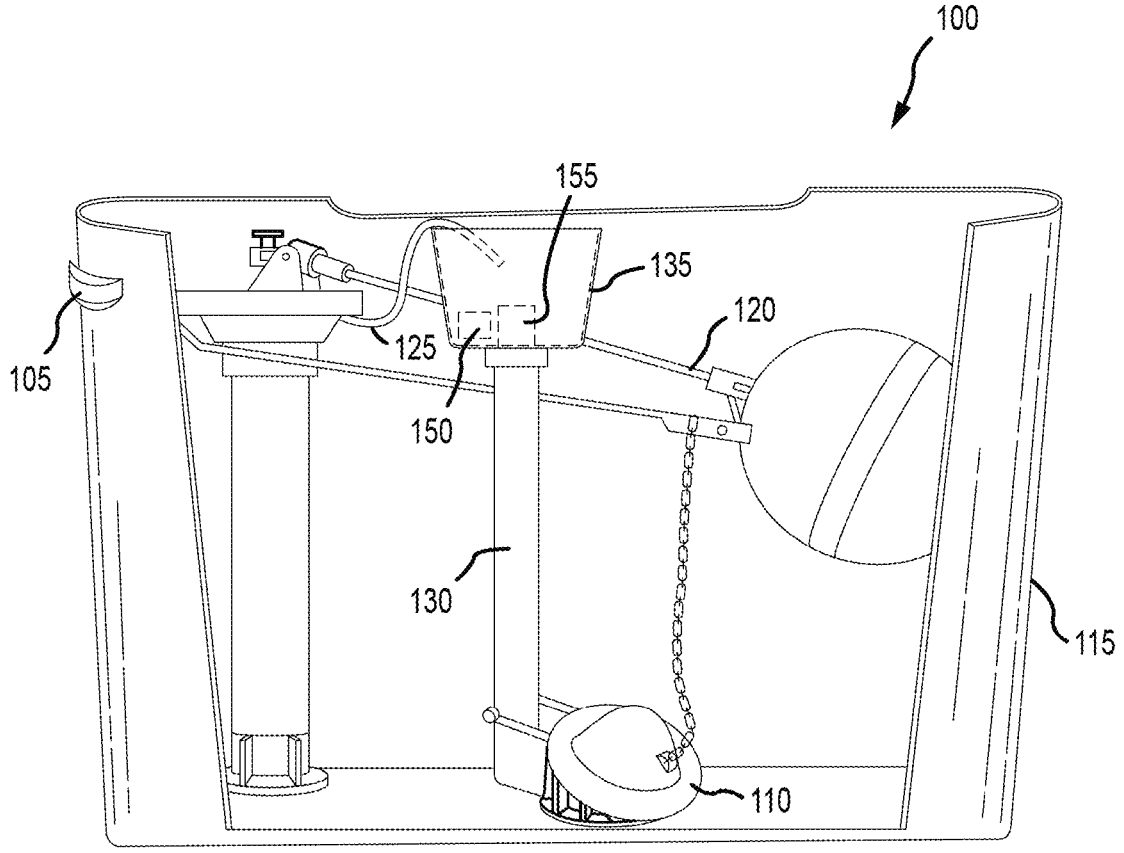
FIG. 1 illustrates an exemplary toilet bowl cleaning cup system having the toilet bowl cleaning cup mounted on the overflow pipe of a flapper assembly, in accordance with various embodiments.

In various embodiments, as set forth in FIG. 1, the flapper system may include a holding device 135 in the tank 115 that is configured to allow fill water from a fill tube 125 to interact or mix with a cleaning substance 150, then flow into the bowl. The holding device 135 may be any shape, size or material. For example, the holding device 135 may be in the form of a cup. In various embodiments, the cup should be limited in size so as to fit within the tank and below the cover of the tank. The holding device 135 may include internal ledges, flares or side internal projections to hold the clip that secures the fill tube 125 onto the holding device 135. In this way, the clip can be affixed to the inside of the holding device 135 to avoid interaction with outside components.

The holding device 135 may include a hole 155 on the bottom of the holding device 135, wherein the hole 155 is at least partially aligned with, and/or interfaces with, the top of the overflow pipe 130. The bottom of the overflow pipe 130 may include cam locks to support the overflow pipe 130. In various embodiments, the bottom of the holding device 135 may include an inner cylinder over the hole 155 and emanating out of the hole 155. In various embodiments, the top of the overflow pipe 130 may extend through the hole 155 of the holding device 135 and into the holding device 135, such that the top portion of the overflow pipe 130 forms a similar configuration as the inner cylinder. The water is retained in the holding device 135 (soaking in the cleaning solution), until the water level reaches over the top of the inner cylinder. The inner cylinder may be any size, shape or material. The inner cylinder may have a diameter similar to the diameter of the hole 155 and may have a height of about 1 inch. The bottom of the holding device 135 may include one or more ridges next to or around the hole 155 such that the ridge may abut the top of the overflow pipe 130. Such a ridge allows the cup to be above the top of the overflow pipe 130. The ridge may be about ⅛ inch such that the bottom of the hole 155 is about ⅛ inch above the top of the overflow pipe 130. The hole 155 in the bottom of the holding device 135 allows the fill water to flow out of the bottom of the holding device 135 and into the overflow pipe 130. In various embodiments, the hole 155 may be located in any portion of the holding device 135. For example, the hole 155 may be on the side of the holding device 135 and allow the fill water to flow out of the side of the holding device 135 and into the top or side of the overflow pipe 130.

Figure 3:
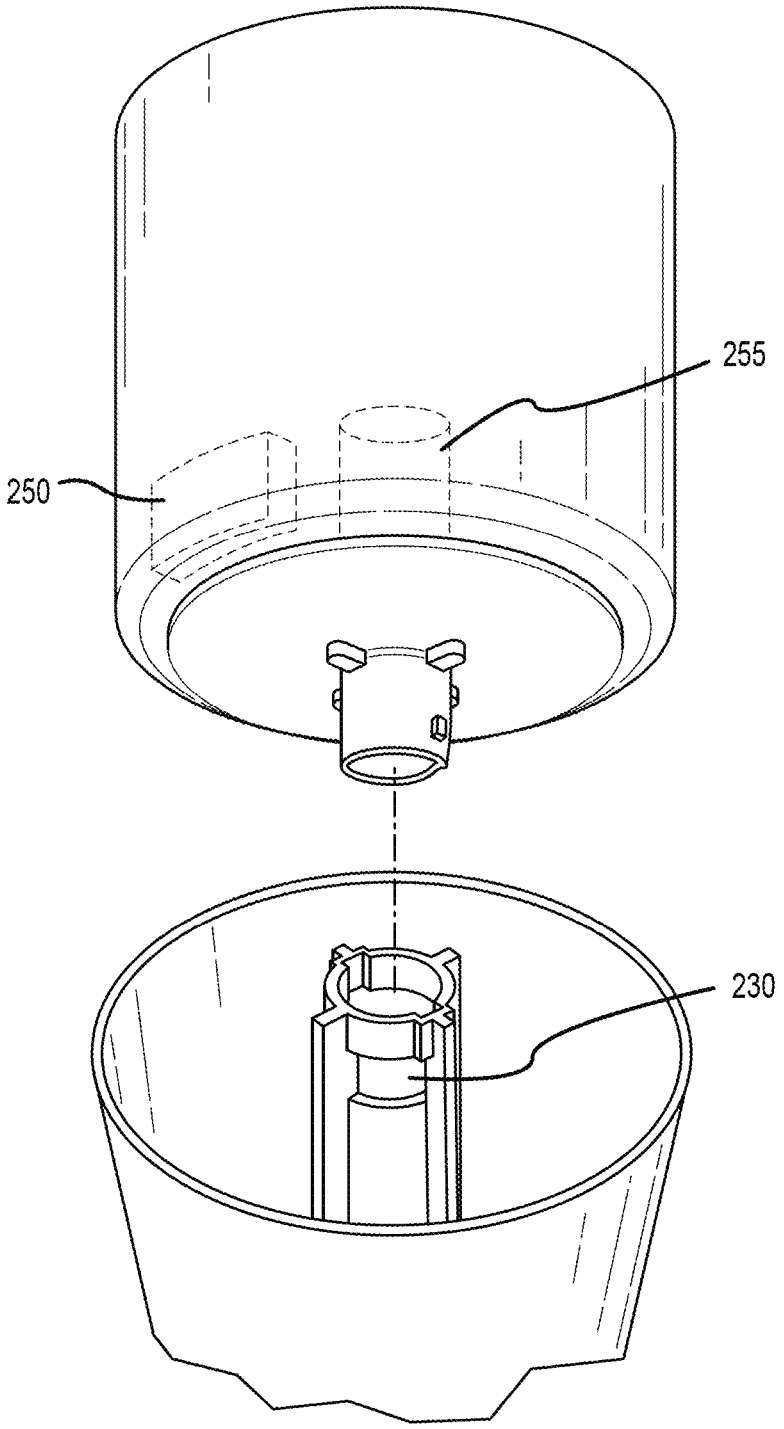
FIG. 3 illustrates an exemplary cam lock arrangement between the holding device and an overflow pipe, in accordance with various embodiments.

With continued reference to FIG. 1, in various embodiments, the overflow pipe 130 may incorporate the holding device 135 as part of an integral unit. As such, the overflow pipe 130 and holding device 135 may be created together in the same molding process such that the overflow pipe 130 and holding device 135 are integral components. In various embodiments, the holding device 135 may be secured to, integrated with and/or attached to the overflow pipe 130. The attachment between the holding device 135 and overflow pipe 130 may include, for example, a cam lock, screw on and/or push on. FIG. 3 is an exemplary cam lock arrangement that may be used to connect the holding device 135 to the overflow pipe 130. The cam lock arrangement may include an extra connector to facilitate the cam lock arrangement on the holding device 135 and/or overflow pipe 130. The bottom of the holding device 135 and/or the top of overflow pipe 130 may include a threaded surface. For example, the outside of the bottom of the holding device 135 may include threads and the inside of the top of the overflow pipe 130 may include inside threads, such that the holding device 135 may screw into the overflow pipe 130. The push on arrangement may include an extra connector to facilitate the push on arrangement on the holding device 135 and/or overflow pipe 130.

The system may include a screen over the top entrance of the overflow pipe 130. The screen may prevent portions of the cleaning substance 150 from entering the overflow pipe 130. The screen may prevent portions of the cleaning substance 150 from at least partially blocking the overflow pipe 130.

With continued reference to FIG. 1, in various embodiments, the interaction or mixing with the cleaning substance 150 may include the fill water going onto, over and/or through a cleaning substance 150, or the cleaning substance 150 being added to the fill water. The cleaning substance 150 may be in the form of a powder, gel, liquid, tablet, pod or any other form that may be placed, added or loaded into the holding device 135. The cleaning substance 150 may be configured in any shape. For example, the cleaning substance 150 may be a rectangle or a round shape. The cleaning substance 150 shape may match the shape of the holding device 135. The cleaning substance 150 may be placed directly into the holding device 135, which avoids the expense and hassle of finding and using proprietary cleaning cartridges.

Because the holding device 135 may be configured to interface with the opening of the overflow pipe 130, the holding device 135 does not need to attach to the side of the tank 115. The holding device 135 may include a cover over the top of the holding device 135. The cover may be a removable cover, a hinged cover or a sliding cover. The fill water exits a hole 155 in the holding device 135 and runs into the opening of the overflow pipe 130. The holding device 135 may have an attachment mechanism that may simply slide within or around the existing overflow pipe 130, so the holding device 135 may be easily installed by the homeowner. Because the cleaning agent (or the fill water with the cleaning agent) does not interface with any of the existing components (tubes, washers, flappers, etc.) in the tank 115, the system reduces damage to the components and tubes in the tank 115. This reduces the need for plumbing repairs. The holding device 135 may be comprised of any material such as, for example, plastic, rubber, metal, wood, composite or any other substance that is configured to hold a cleaning substance 150.

In various embodiments, the holding device 135 may include a bottom and a side wall around the bottom. The side wall may be any height. For example, the side wall may extend about ⅜ inch above the bottom of the holding device 135. The bottom of the holding device 135 may include a ring portion (surrounding the overflow pipe 130) that comprises any container that holds, stores or retains the cleaning substance 150. The holding device 135 may include a recessed portion or container to hold the cleaning substance 150. The recessed portion may allow the water to soak in the cleaning substance 150 until a sufficient amount of water is in the ring potion of the holding device 135 to exceed the recessed portion and overflow into the overflow pipe 130. The system may comprise any of the features set forth in U.S. Pat. No. 11,821,189 issued on Nov. 21, 2023, which is hereby incorporated by reference in its entirety for all purposes.

The method may comprise removing the fill tube 125 from the overflow pipe 130. Inserting or attaching the holding device 135 to the overflow pipe 130. The cleaning substance 150 is placed into the holding device 135. The fill tube 125 may be placed into or attached to the holding device 135. The fill tube 125 may be attached to the holding device 135 with the same clip that was used to attach the fill tube 125 to the overflow pipe 130.

Figure 2:
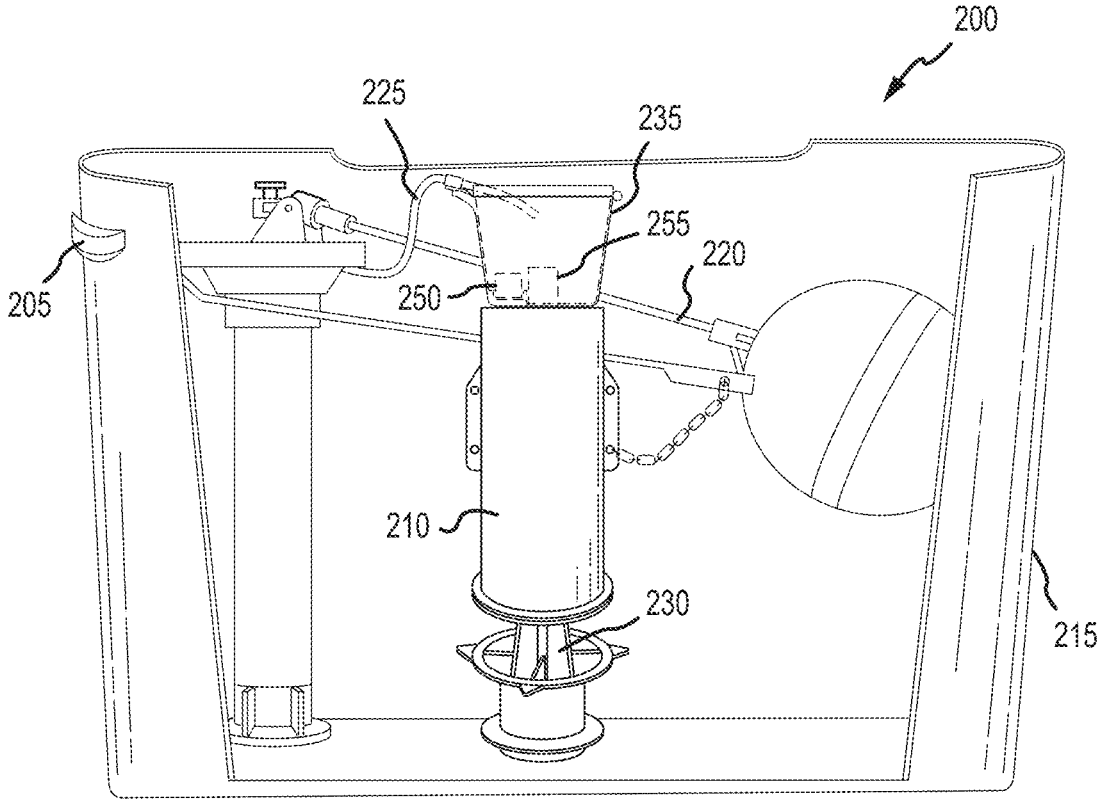
FIG. 2 illustrates an exemplary toilet bowl cleaning cup system having the toilet bowl cleaning device integrated with the overflow pipe of a cannister assembly, in accordance with various embodiments.

In various embodiments, as set forth in FIG. 2, the cannister system may include a holding device 235 in the tank 215 that is configured to allow fill water from a fill tube 225 to interact or mix with a cleaning substance 250, then flow into the bowl. The holding device 235 may be any shape, size or material. For example, the holding device 235 may be in the form of a cup. In various embodiments, the holding device 235 should be limited in size so as to fit within the tank and below the cover of the tank. Moreover, in various embodiments, the holding device 235 should have an outer circumference or width that is smaller than the inner circumference of the cannister, such that the cannister can lift up and translate over the cup. For similar reasons, the holding device 235 may include internal ledges, flares or side internal projections to hold the clip that secures the fill tube 225 onto the holding device 235. In this way, the clip can be affixed to the inside of the holding device 235 to avoid interaction with the cannister or other outside components. Fill tube 225 may be temporarily removed from overflow pipe 230 in order to install holding device 235, then an end of fill tube 225 put into holding device 235 or reattached to overflow pipe 230 and/or inner cylinder.

The holding device 235 may include a hole 255 on the bottom of the holding device 135, wherein the hole 255 is at least partially aligned with, and/or interfaces with, the top of the overflow pipe 230. In various embodiments, the bottom of the holding device 235 may include an inner cylinder over the hole 255 and emanating out of the hole 255. In various embodiments, the top of the overflow pipe 230 may extend through the hole 255 of the holding device 235 and into the holding device 235, such that the top portion of the overflow pipe 230 forms a similar configuration as the inner cylinder. The water is retained in the holding device 235 (soaking in the cleaning solution), until the water level reaches over the top of the inner cylinder. The inner cylinder may be any size, shape or material. For example, the inner cylinder may be a rounded or squared shape. The inner cylinder may have a diameter similar to the diameter of the hole 255 and may have a height of about 1 inch. The bottom of the holding device 235 may include one or more ridges next to or around the hole 255 such that the ridge may abut the top of the overflow pipe 230. Such a ridge allows the cup to be above the top of the overflow pipe 230. The ridge may be about ⅛ inch such that the bottom of the hole 255 is about ⅛ inch above the top of the overflow pipe 230. The hole 255 in the bottom of the holding device 235 allows the fill water to flow out of the bottom of the holding device 235 and into the overflow pipe 230. In various embodiments, the hole 255 may be located in any portion of the holding device 235. For example, the hole 255 may be on the side of the holding device 235 and allow the fill water to flow out of the side of the holding device 235 and into the top or side of the overflow pipe 230.

With continued reference to FIG. 2, in various embodiments, the overflow pipe 230 may incorporate the holding device 235 as part of an integral unit. As such, the overflow pipe 230 and holding device 235 may be created together in the same molding process. In various embodiments, the holding device 235 may be secured to, integrated with and/or attached to the overflow pipe 230. The attachment between the holding device 235 and overflow pipe 230 may include, for example, a cam lock, screw on and/or push on. FIG. 3 shows an exemplary cam lock arrangement between the holding device 235 and overflow pipe 230. The cam lock arrangement may include an extra connector to facilitate the cam lock arrangement on the holding device 235 and/or overflow pipe 230. The bottom of the holding device 235 and/or the top of overflow pipe 230 may include a threaded surface. For example, the outside of the bottom of the holding device 235 may include threads and the inside of the top of the overflow pipe 230 may include inside threads, such that the holding device 235 may screw into the overflow pipe 230. The push on arrangement may include an extra connector to facilitate the push on arrangement on the holding device 235 and/or overflow pipe 230.

The system may include a screen over the top entrance of the overflow pipe 230. The screen may prevent portions of the cleaning substance 250 from entering the overflow pipe 230. The screen may prevent portions of the cleaning substance 250 from at least partially blocking the overflow pipe 230.

With continued reference to FIG. 2, in various embodiments, the interaction or mixing with the cleaning substance 250 may include the fill water going onto, over and/or through a cleaning substance 250, or the cleaning substance 250 being added to the fill water. The cleaning substance 250 may be in the form of a powder, gel, liquid, tablet, pod or any other form that may be placed, added or loaded into the holding device 235. The cleaning substance 250 may be configured in any shape. For example, the cleaning substance 250 may be a rectangle or a round shape. The cleaning substance 250 shape may match the shape of the holding device 235. The cleaning substance 250 may be placed directly into the holding device 235, which avoids the expense and hassle of finding and using proprietary cleaning cartridges.

Because the holding device 235 may be configured to interface with the opening of the overflow pipe 230, the holding device 235 does not need to attach to the side of the tank 215. The holding device 235 may include a cover over the top of the holding device 235. The cover may be a removable cover, a hinged cover or a sliding cover. Moreover, in various embodiments, the cover of the holding device 235 should have an outer circumference or width that is smaller than the inner circumference of the cannister, such that the cannister can lift up and translate over the cover. The fill water exits a hole 255 in the holding device 235 and runs into the opening of the overflow pipe 230. The holding device 235 may have an attachment mechanism that may simply slide within or around the existing overflow pipe 230, so the holding device 235 may be easily installed by the homeowner. Because the cleaning agent (or the fill water with the cleaning agent) does not interface with any of the existing components (tubes, washers, flappers, etc) in the tank 215, the system reduces damage to the components and tubes in the tank 215. This reduces the need for plumbing repairs. The holding device 235 may be comprised of any material such as, for example, plastic, rubber, metal, wood, composite or any other substance that is configured to hold a cleaning substance 250.

In various embodiments, the holding device 235 may include a bottom and a side wall around the bottom. The side wall may be any height. For example, the side wall may extend about ⅜ inch above the bottom of the holding device 235. The bottom of the holding device 235 may include a ring portion 240 (surrounding the overflow pipe 230) that comprises any container that holds, stores or retains the cleaning substance 250. The holding device 235 may include a recessed portion or container to hold the cleaning substance 250. The recessed portion may allow the water to soak in the cleaning substance 250 until a sufficient amount of water is in the ring potion of the holding device 235 to exceed the recessed portion and overflow into the overflow pipe 230.

The method may comprise removing the fill tube 225 from the overflow pipe 230. Inserting or attaching the holding device 235 to the overflow pipe 230. The cleaning substance 250 is placed into the holding device 235. The fill tube 225 may be placed into or attached to the holding device 235 such that the attachment of the fill tube 225 does not interfere with the translation of the cannister. The fill tube 225 may be attached to the holding device 235 with the same clip that was used to attach the fill tube 225 to the overflow pipe 230.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. Furthermore, any reference to singular includes plural embodiments, and any reference to more than one component may include a singular embodiment. Although specific advantages have been enumerated herein, various embodiments may include some, none, or all of the enumerated advantages.

In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. No claim element is intended to invoke 35 U.S.C. § 112 (f) unless the element is expressly recited using the phrase "means for" or "step for". As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

I claim:

1. A system comprising:

an overflow pipe within a cannister;

the cannister configured to translate along at least a portion of a length of the overflow pipe;

a bottom of the cannister configured to adjust to allow tank water to flow into a toilet bowl;

a holding device configured to interface with the overflow pipe;

the holding device configured to receive fill water;

the holding device configured to retain a cleaning substance; and the holding device configured to allow the fill water to flow over the cleaning substance and be retained in the holding device for a period of time until the fill water rises to a level where the fill water reaches a level that rises above an inner cylinder over a hole and into the overflow pipe.

2. The system of claim 1, further comprising an inner cylinder over a hole in the holding device.

3. The system of claim 1, further comprising an inner cylinder over a hole in the holding device, wherein the fill water is retained in the holding device until the fill water reaches the height of the inner cylinder, then the fill water starts to overflow into the inner cylinder.

4. The system of claim 1, wherein the holding device includes a recessed area.

5. The system of claim 1, wherein the holding device includes a recessed area having a geometric shape that matches a geometric shape of the cleaning substance.

6. The system of claim 1, wherein the holding device is configured to receive the fill water from a fill tube.

7. The system of claim 1, wherein the holding device includes a cover.

8. The system of claim 1, wherein the holding device includes at least one of a removable cover, a hinged cover or a sliding cover.

9. The system of claim 1, further comprising at least one of an internal ledge, flare or side internal projection on the holding device to hold a clip that secures a fill tube onto the holding device.

10. The system of claim 1, wherein an outside bottom of the holding device includes one or more of at least one of ridges, cam, threads or press fit.

11. The system of claim 1, wherein the holding device is configured to receive at least one of a re-fill or replacement of the cleaning substance.

12. The system of claim 1, wherein a geometric shape of the cleaning substance is similar to the geometric shape of the holding device.

13. The system of claim 1, wherein the holding device is configured to directly receive the cleaning substance.

14. The system of claim 1, wherein the bottom of the cannister configured to adjust includes the bottom of the cannister configured to translate upward.

* * * * *